United States Patent [19]

Go et al.

[11] Patent Number: 5,068,059

[45] Date of Patent: Nov. 26, 1991

[54] CORROSION INHIBITOR

[75] Inventors: Winston S. Go, Randolph; Joseph S. Roti, West Milford; Mark G. Lang, Wayne; Charles O. Weiss, Plainsboro, all of N.J.

[73] Assignee: Drew Chemical Corporation, Boonton, N.J.

[21] Appl. No.: 465,279

[22] Filed: Jan. 16, 1990

[51] Int. Cl.[5] ..... C23F 11/10

[52] U.S. Cl. ..... 252/389.53; 252/389.22; 252/181; 210/699; 422/15; 422/16; 422/17; 422/19

[58] Field of Search ..... 210/699; 252/181, 389.53, 252/389.22; 422/15, 16, 17, 19

[56] References Cited

U.S. PATENT DOCUMENTS

| | | | |
|---|---|---|---|
| 4,163,733 | 8/1979 | Buckman et al. | 422/15 |
| 4,181,806 | 1/1980 | Fenyes et al. | 422/15 |
| 4,374,040 | 2/1983 | Fenyes et al. | 422/15 |
| 4,497,713 | 2/1985 | Geiger | 252/181 |
| 4,606,890 | 8/1986 | Fisk | 422/15 |
| 4,640,818 | 2/1987 | Grierson et al. | 422/15 |
| 4,774,018 | 9/1988 | Chagnard, Jr. et al. | 252/181 |
| 4,869,827 | 9/1989 | Chagnard, Jr. et al. | 210/701 |
| 4,872,996 | 10/1989 | Grierson | 252/181 |
| 4,885,136 | 12/1989 | Katayama et al. | 422/15 |

FOREIGN PATENT DOCUMENTS 0151636 10/1981 Fed. Rep. of Germany .

*Primary Examiner*—Deborah L. Kyle
*Assistant Examiner*—Valerie Fee
*Attorney, Agent, or Firm*—Walter H. Schneider

[57] ABSTRACT

A corrosion inhibitor for aqueous systems containing ferrous and non-ferrous metallic surfaces comprising (a) hydroxyphosphonoacetic acid, or a water soluble salt thereof, and (b) an aminoalkylenephosphonic acid derivative, or a water soluble salt thereof.

3 Claims, No Drawings

CORROSION INHIBITOR

BACKGROUND OF THE INVENTION

1. Field of the Invention

The present invention relates to corrosion inhibition. More particularly, the present invention relates to corrosion inhibition in aqueous systems. Still more particularly, the present invention relates to a composition and method for controlling corrosion of metal in aqueous systems.

2. Description of the Prior Art

Numerous chemical materials and combinations of materials have long been employed for inhibiting corrosion of metals in the aqueous cooling systems of industrial manufacturing processes, commercial and institutional air conditioning systems, steam generating systems, and the like. Included among such chemical materials are chromates, zinc salts, nitrites, silicates nitrates, polyphosphates and benzoates. More recently, organophosphonates have found increased use as mild steel corrosion inhibitors in aqueous systems because of their greater resistance to hydrolysis. As compared to polyphosphates, therefore, this renders them less prone to insoluble orthophosphate formation which tend to plug piping and affect the heat transfer surfaces of the systems in which they are employed. Organophosphonate inhibitors, moreover, are environmentally more acceptable than zinc salt and chromate inhibitors, both of which are effective but restrictive in use because of their toxicities. Examples of organophosphonates useful as corrosion inhibitors in aqueous systems are 2-hydroxyphosphonoacetic acid and aminoalkylenephosphonic acid derivatives in combination with a managanese compound as disclosed in U.S. Pat. Nos. 4,640,818 and 4,774,018.

SUMMARY OF THE INVENTION

In accordance with the present invention, it has now been found that a corrosion inhibiting composition comprising as the principal active ingredients (a) 2-hydroxyphosphonoacetic acid as the one component, and (b) a partially neutralized aminoalkylenephosphonic acid derivative containing a small amount of chelated manganous ion ($Mn^{+2}$) as the other component, is an effective inhibitor against the corrosion of metals, especially ferrous metals, in aqueous systems. Particularly surprising is the fact that the composition exhibits a synergism, i.e., it is a more effective ferrous metal corrosion inhibitor than either component of the composition when used separately in a like amount and under like conditions.

DESCRIPTION OF THE PREFERRED EMBODIMENT

Hydroxyphosphonoacetic acid, the first component of the corrosion inhibiting composition of this invention, has the chemical structure

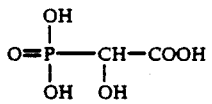

Hydroxyphosphonoacetic acid is a known compound and is prepared by known methods. Its use as a metal corrosion inhibitor in aqueous systems, either as the free acid or as a water soluble salt, is disclosed in U.S. Pat. No. 4,689,200.

Aminoalkylenephosphonic acid derivatives in combination with a small amount of chelated manganous ion comprising the second component of the corrosion inhibiting composition of this invention, are also known. A claim of synergism for such a combination when used as a corrosion inhibitor in aqueous systems is made in U.S. Pat. No. 4,640,818, while the use of a composition comprising the combination together with an acrylate polymer is disclosed in U.S. Pat. No. 4,774,018.

The aminoalkylenephosphonic acid derivatives used in accordance to this invention have the following chemical structure

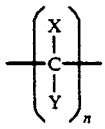

wherein X and Y are independently selected from hydrogen, hydroxyl, carboxyl, phosphonic, salts of the acid radicals and hydrocarbon radicals having from 1–12 carbon atoms and wherein n is 1–3, with the proviso that when $n > 1$, each X and Y may be the same as or different from any other X or Y on any carbon atom.

The above chemical structure and the aminoalkylenephosphonic acid derivatives used in accordance with this invention are disclosed in detail in U.S. Pat. No. 4,774,018. Also disclosed are the manganese compounds that may be employed as a source of manganous ion, the weight ratio of the aminoalkylenephosphonic acid derivative to manganese and the alternative procedures for chelating the manganese. All of the disclosure of U.S. Pat. No. 4,774,018 detailing the managanese compounds, the aminoalkylenephosphonic acid derivatives, the preferred ratios of the aminoalkylenephosphonic acid derivative to manganese is incorporated herein as if fully set forth.

The range of ratios within which the two components are used in the corrosion inhibitor composition of this invention will have limits at which a synergistic inhibiting effect is first observed. This has been found to occur when the two components are in a weight ratio of about 1:10–10:1. Usually, the ratio employed will be more on the order of 1:4–4:1 with a preferred ratio being about 1:1.

The corrosion inhibiting composition of this invention can be separately added directly to the system being treated, but will usually be added to the system in the form of an aqueous composition containing other water treatment ingredients, e.g., defoamers, dispersants, biocides, antiscalants, and the like with which it is particularly compatible. The amount of the inhibitor employed will depend upon the composition of the aqueous system to be treated, the nature of the metal surface areas to be protected, processing conditions within the system, and the like. In general, the corrosion inhibiting composition can be used in concentrations ranging from as little as 0.1 ppm to as much as 100 ppm, but will more usually be used in a concentration of about 1–10 ppm.

The corrosion inhibitor of the present invention is particularly effective for inhibiting the corrosion of ferrous containing metals such as mild steel. Accordingly, it has particular applicability in inhibiting corrosion in cooling water systems in which cooling water is cycled without the use of acid to reduce pH. The corrosion inhibitor, however, is also effective in controlling corrosion in aqueous systems which also contain yellow metals, i.e., brass and copper.

The present invention is further described in the following Example in which all parts are by weight unless otherwise indicated.

EXAMPLE

The corrosion inhibiting properties of the composition according to this invention were evaluated, as were those of its components, in an aqueous environment designed to simulate the cooling water cycled in the towers of a cooling water system. Preweighed mild steel and admiralty brass coupons were affixed to a heat transfer surface immersed in a recirculating system using cooling water having a concentration of 435 ppm $CaCl_2$, 244 ppm $MgSO_4.7H_2O$ and 220 ppm $NaHCO_3$. The surfaces of the coupons were maintained at a constant temperature typical of that encountered in cooling water systems by extracting heat with thermostated, recirculating cooling water maintained at pH 7.8–8.3.

The composition of this invention was tested in varying ratios of components. The components were also tested separately so as to illustrate the surprising synergistic effect of the composition. The cooling water was dosed at a pretreatment/ maintenance level of 300/150 ppm with a water treatment formulation containing the inhibitor composition, or the separate inhibitor components thereof, in an amount sufficient to provide 10 ppm of inhibitor to cooling water. The tests were conducted for 72 hours after which the coupons were cleaned, dried and reweighed. The metal loss was converted to a corrosion rate expressed in mils/year (mpy).

Results appear in the following Table.

TABLE

| CORROSION INHIBITOR (ppm) | | CORROSION RATE (mpy) | |
|---|---|---|---|
| 1st Comp[a] | 2nd Comp[b] | Mild Steel[c] | Brass[d] |
| 10.0 | 0.0 | 6.2 | 0.2 |
| 8.7 | 1.4 | 3.7 | 0.1 |
| 5.0 | 5.0 | 3.4 | 0.1 |
| 0.0 | 10.0 | 6.6 | 0.1 |

[a]Hydroxyphosphonoacetic acid commercially available under the trademark BELCOR 575 from Ciba-Geigy Corporation.
[b]An aminoalkylenephosphonic acid derivative containing a small amount of chelated manganous ion commercially available under the trademark VERSENEX CSI from The Dow Chemical Company.
[c]Mild steel corrosion rate in untreated water 45.4 mpy.
[d]Brass corrosion rate in untreated water 0.9 mpy.

The data of the Table show that the composition of this invention provides superior corrosion inhibition with respect to mild steel, and as good inhibition with respect to brass, as is provided with a like amount of either component alone. The test coupons, moreover, showed no signs of pitting.

We claim:

1. A composition for use in inhibiting the corrosion of mild steel surfaces in an alkaline cooling water system in which the active components are (a) hydroxyphosphonoacetic acid, or a water soluble salt thereof, and (b) an aminoalkylenephosphonic acid derivative, or a water soluble salt thereof, the latter in combination with a manganese compound, said components (a) and (b) being in a weight ratio of about 1:10-10:1.

2. A composition according to claim 1 in which the active components (a) and (b) are in a weight ratio of about 1:1.

3. A method of inhibiting the corrosion of mild steel surfaces in an alkaline cooling water system which comprises incorporating in the system an effective amount of a composition according to claim 1.

* * * * *